United States Patent [19]

Richter

[11] 4,254,688

[45] Mar. 10, 1981

[54] LOW FRICTION SERVO VALVE

[75] Inventor: Robert F. Richter, Rolling Hills Estates, Calif.

[73] Assignee: The United States of America as represented by the Secretary of the Air Force, Washington, D.C.

[21] Appl. No.: 35,574

[22] Filed: May 3, 1979

[51] Int. Cl.[3] ..... F15B 13/16

[52] U.S. Cl. ..... 91/365; 91/359

[58] Field of Search ..... 91/365, 359

[56] References Cited

U.S. PATENT DOCUMENTS

| | | | |
|---|---|---|---|
| 3,171,329 | 3/1965 | Rasmussen | 91/365 |
| 3,257,911 | 6/1966 | Garnjost et al. | 91/365 |
| 3,464,318 | 9/1969 | Thayer et al. | 91/365 |

*Primary Examiner*—Paul E. Maslousky

*Attorney, Agent, or Firm*—Donald J. Singer; Jacob N. Erlich

[57] ABSTRACT

A low friction servo valve having a housing which contains therein an input shaft, a pair of slidably mounted valve spools and an actuator. Mechanical input is received by the input shaft in order to provide rotational displacement thereof. This displacement is transferred to a flapper portion on the input shaft which operates in conjunction with a pair of jet nozzles. Movement of the flapper causes pressure buildup in one of the jet nozzles which in turn causes sequential movement of the pair of valve spools to take place. Operation of the actuator is dependent upon movement of one of the valve spools, with this valve spool also being connected to the input shaft for assisting in the rotational displacement thereof as well as being connected to a feedback spring which forces the flapper to assume its neutral position thereby reducing the pressure buildup in one of the jet nozzles.

10 Claims, 8 Drawing Figures

LOW FRICTION SERVO VALVE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to valves, and, more particularly to a low friction servo valve capable of operating with a minimal input signal or force.

It is becoming increasingly necessary in areas of high technology such as in aircrafts, rockets, or other such propulsion systems to provide power assist valves for the operation thereof, in for example, the actuators. Heretofore, this was accomplished through the use of valves which were machined to extremely high tolerances and which required complex mechanisms therein for assisting in the transfer of an input load or signal to an output signal. In so doing, the reliability of the valves left much to be desired. In many areas, the utilization of actuators were in extremely sensitive and critical areas of operation and therefore any unreliability of a valve associated with the actuators in many instances created the basic problems associated with the actuator itself. Therefore, as technology advances it becomes more and more necessary to provide a servo valve which is capable of reliably assisting in transferring an input load into a useable output, in for example, aircraft actuators or the like.

SUMMARY OF THE INVENTION

The instant invention overcomes the problems encountered in the past by providing a low friction servo valve which is capable of reliably transferring an input signal into a readily usable output.

The low friction servo valve of the instant invention is made up of an input shaft which is operably connected at one end thereof to an input load or signal and at the other end thereof to a series of valve spools. The combination of these valve spools in conjunction with a source of pressurized fluid and a pair of jet nozzles define the elements of the instant servo valve necessary for providing a reliable transfer of the input load or signal in such a manner as to be able to produce an output signal which can be utilized by an actuator. In addition, the series of valve spools act as an aid in allowing a minimal input load to be easily converted into a force capable of motivating the actuator.

With the utilization of the servo valve of this invention, the application of an initial minimal force can be utilized to drive, for a predetermined or preselected period of time, an actuator. The actuator thereby automatically positions itself in the desired position until further application of an input signal to the valve. By increasing the initial load on the valve or by reversing the load in the valve a variety of output signals can be obtained by the actuator attached thereto.

It is therefore an object of this invention to provide a valve which is practically friction free at the input thereof.

It is another object of this invention to provide a low friction servo valve in which the hysterisis is substantially reduced.

It is a further object of this invention to provide a low friction servo valve which requires considerably less operating load and input system rigidity requirements than valves of the past.

It is still a further object of this invention to provide a low friction servo valve which is economical to produce and which utilizes conventional, currently available components that lend themselves standard mass producing manufacturing techniques.

For a better understanding of the present invention together with other and further objects thereof, reference is made to the following description taken into conjunction with the accompanying drawing and its scope will be pointed out in the appended claims.

DETAILED DESCRIPTION OF THE DRAWING

Figure 4:
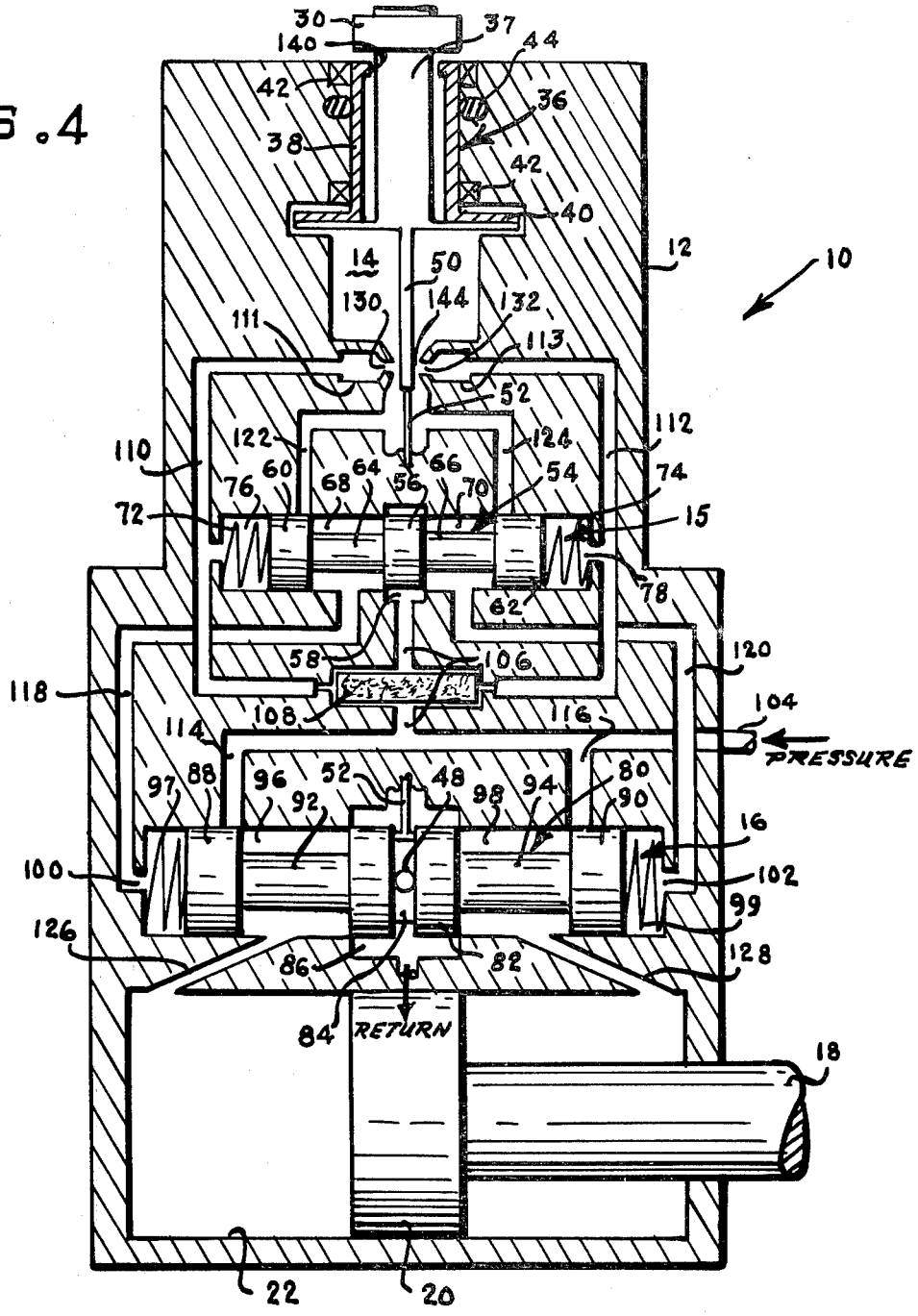
FIG. 4 is a schematic illustration shown partly in cross-section of the low friction servo valve of this invention in the unfolded condition taken along line IV—IV of FIG. 1 so as to more clearly illustrate the relationship between the pressure lines and valve spools.
Figure 5:
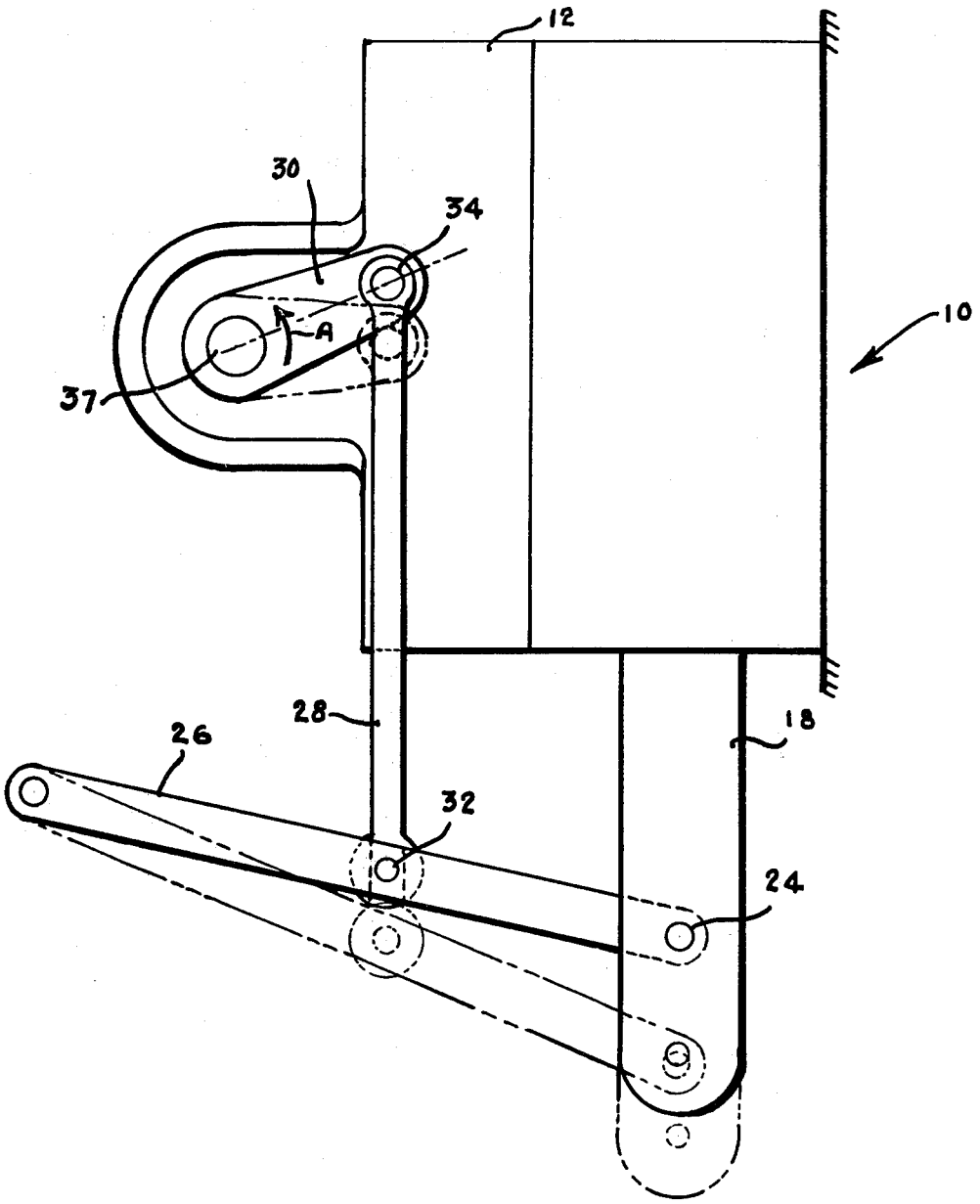
Figure 6:
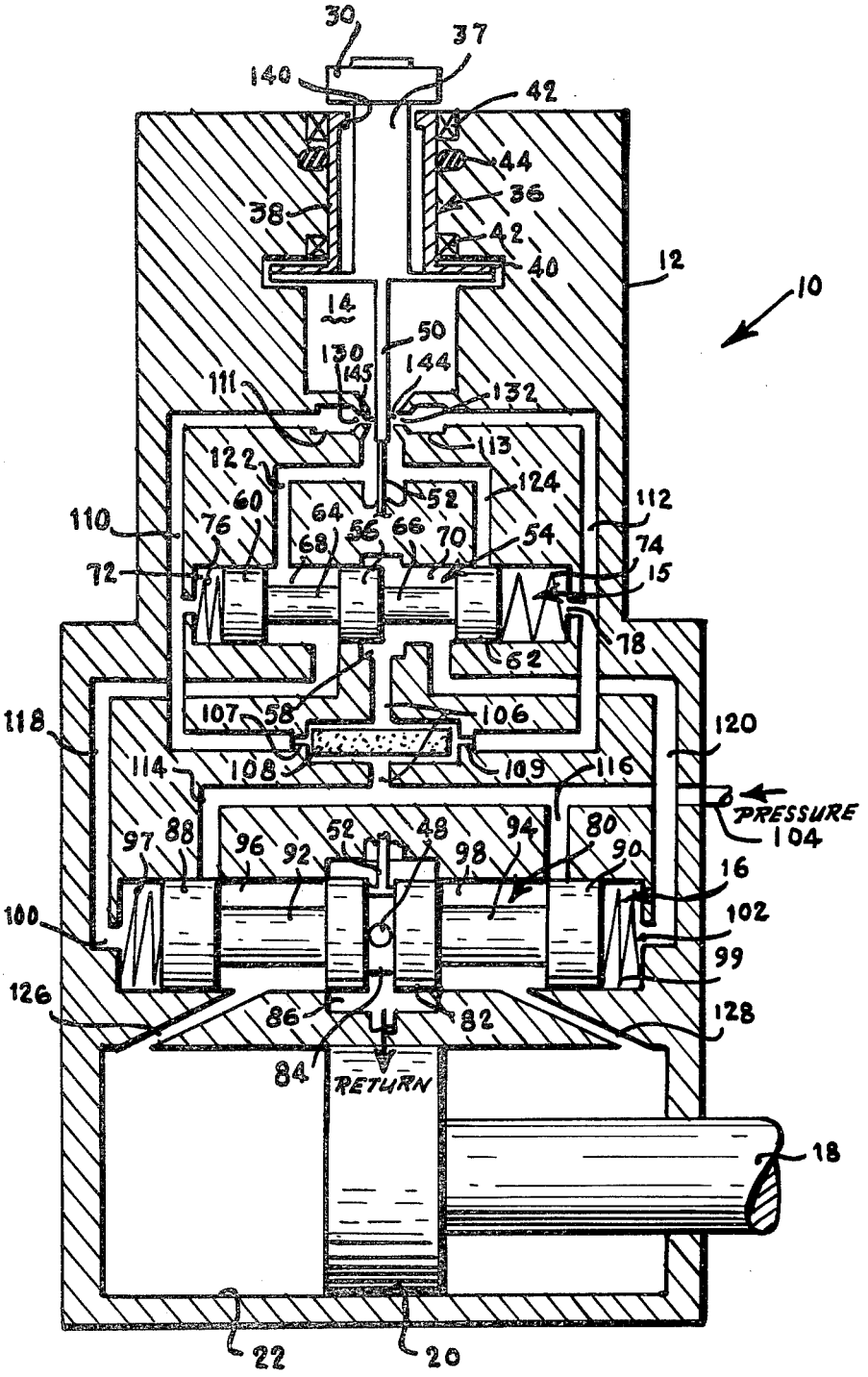
Figure 7:
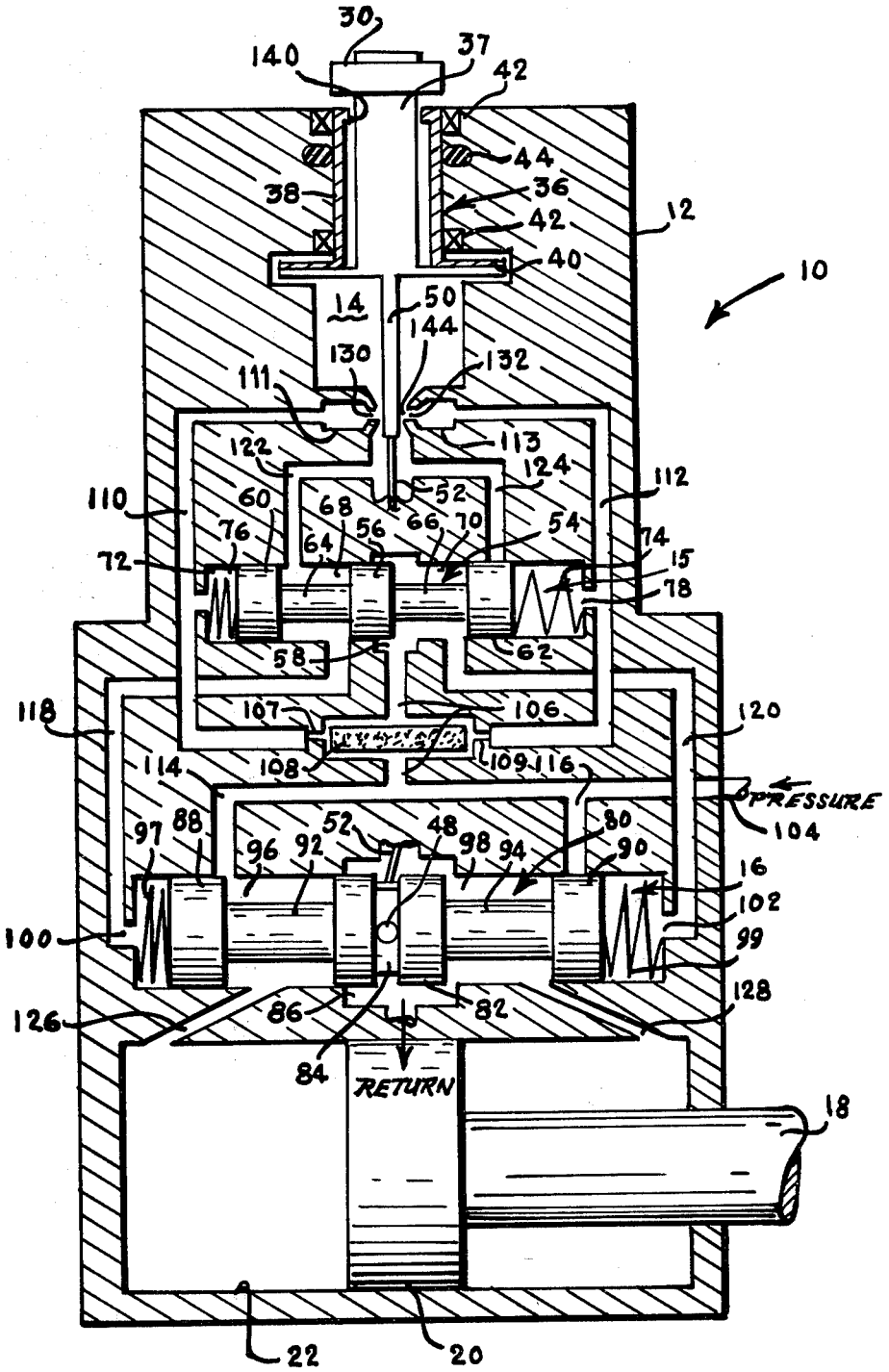
Figure 8:
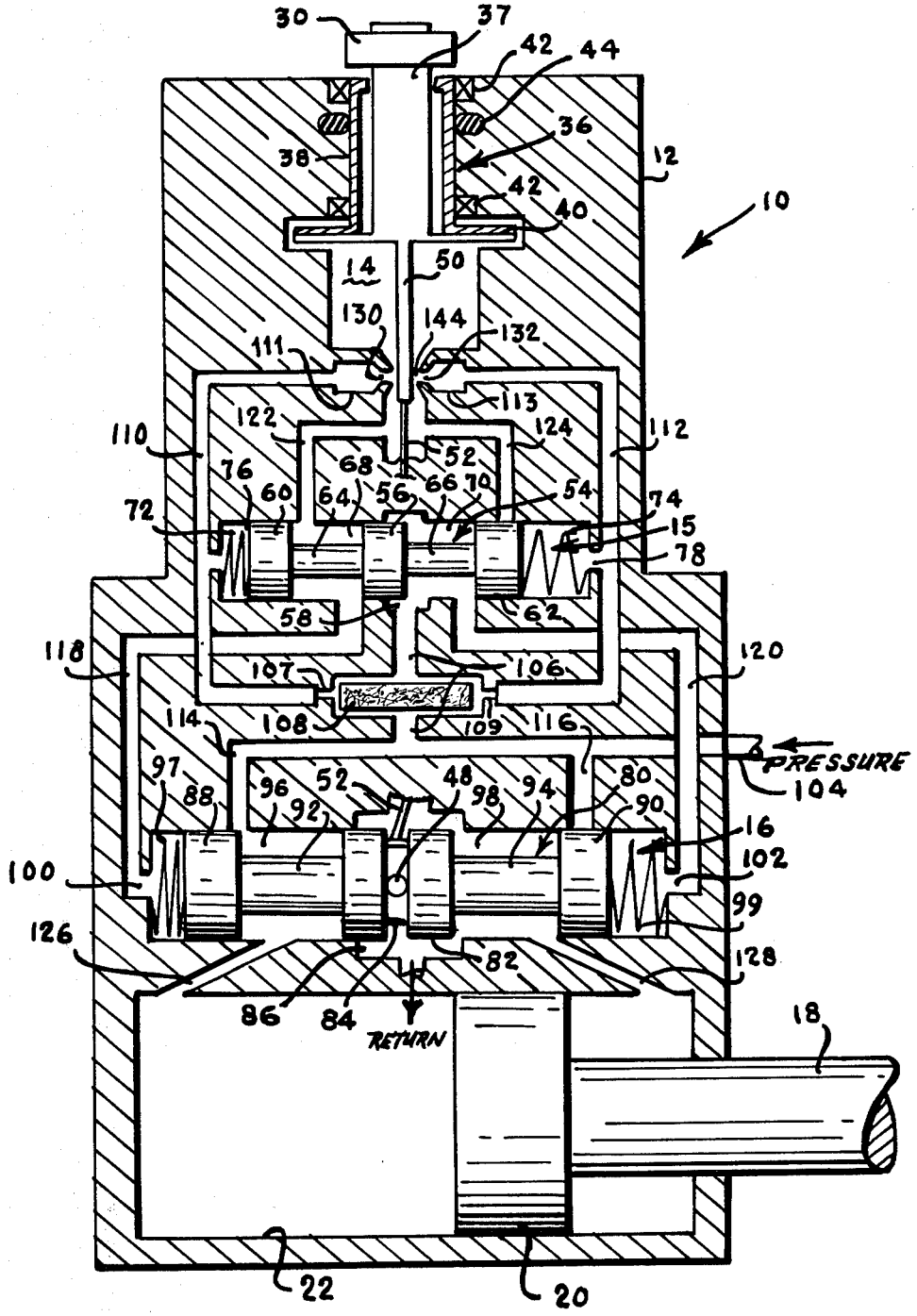

FIG. 5 is a plan view of the low friction servo valve of this invention after an initial input signal or force has been applied to the input shaft of the valve of this invention; and FIGS. 6–8 are schematic illustrations of the low friction servo valve of this invention in the manner shown in FIG. 4 with the spool valves and actuator in their appropriate positions after the application of an initial input signal or force to the input shaft of the valve of this invention.

DETAILED DESCRIPTION OF THE PREFERRED EMBODIMENT

Due to the unique configuration of the low friction servo valve 10 of this invention it is essential, for a proper understanding of this invention, that reference be simultaneously made to FIGS. 1 through 4 of the drawing. For a complete description of the elements making up the low friction servo valve 10 of this invention, reference is now made in particular to FIGS. 1 and 4. Although, FIG. 1 of the drawing shows a cross sectional view of the low friction valve 10 of this invention in many instances the unfolded, schematic cross-sectional view taken along line IV—IV of FIG. 1 and illustrated in FIG. 4 sets forth a better relationship between the elements making up valve 10.

The elements of servo valve 10 of this invention are contained within a body or housing 12. Located within housing 12 is a main, centrally located cavity 14, an initiator spool cavity 15 and a boost spool cavity 16. In addition, an actuator rod 18 is operably connected to a piston 20 which is slidably disposed within a cylinder 22. Cylinder 22 may be located within housing 12 or formed as an integral part thereof.

Figure 2:
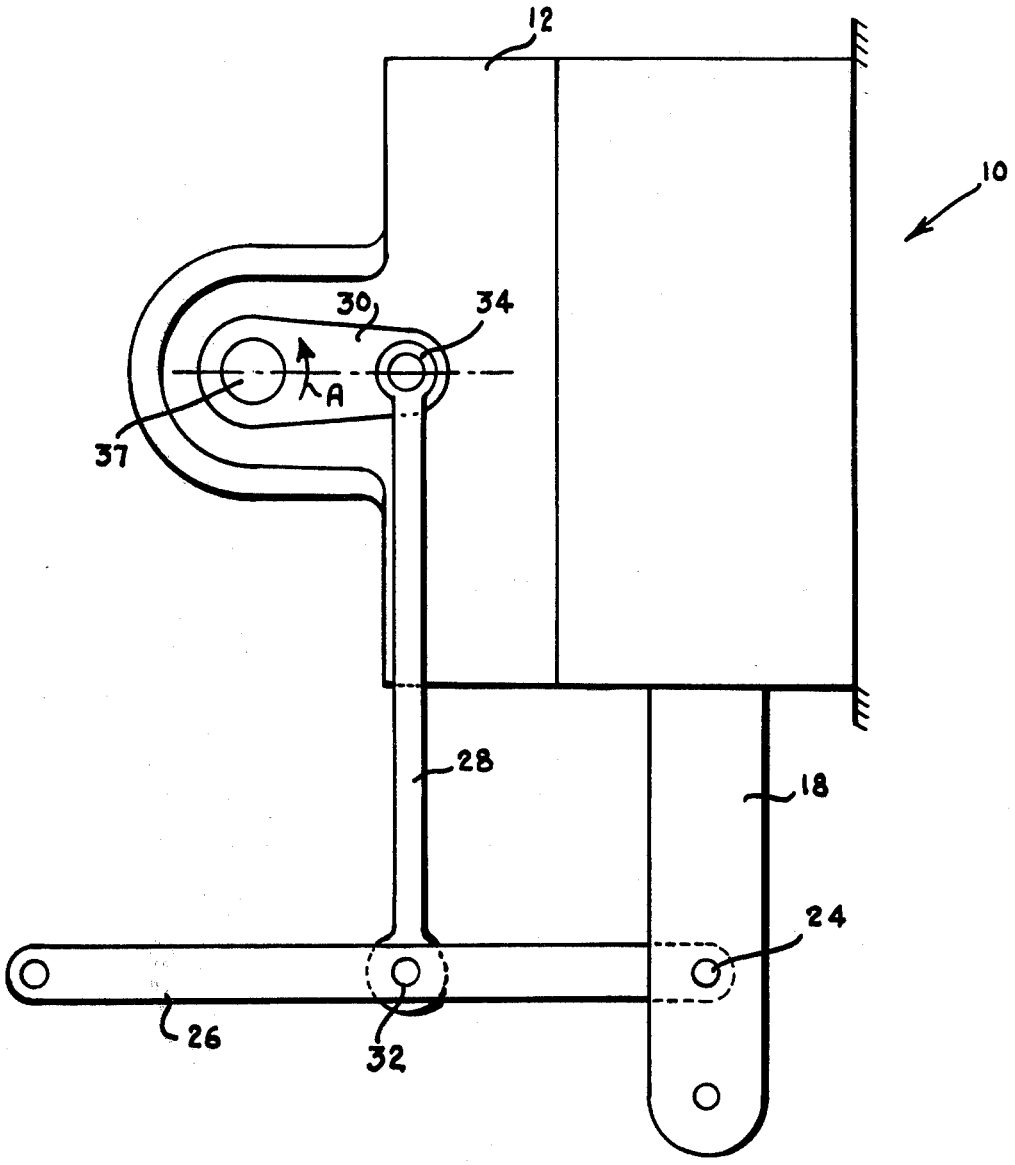
FIG. 2 is a plan view of the low friction servo valve of this invention.
Figure 3:
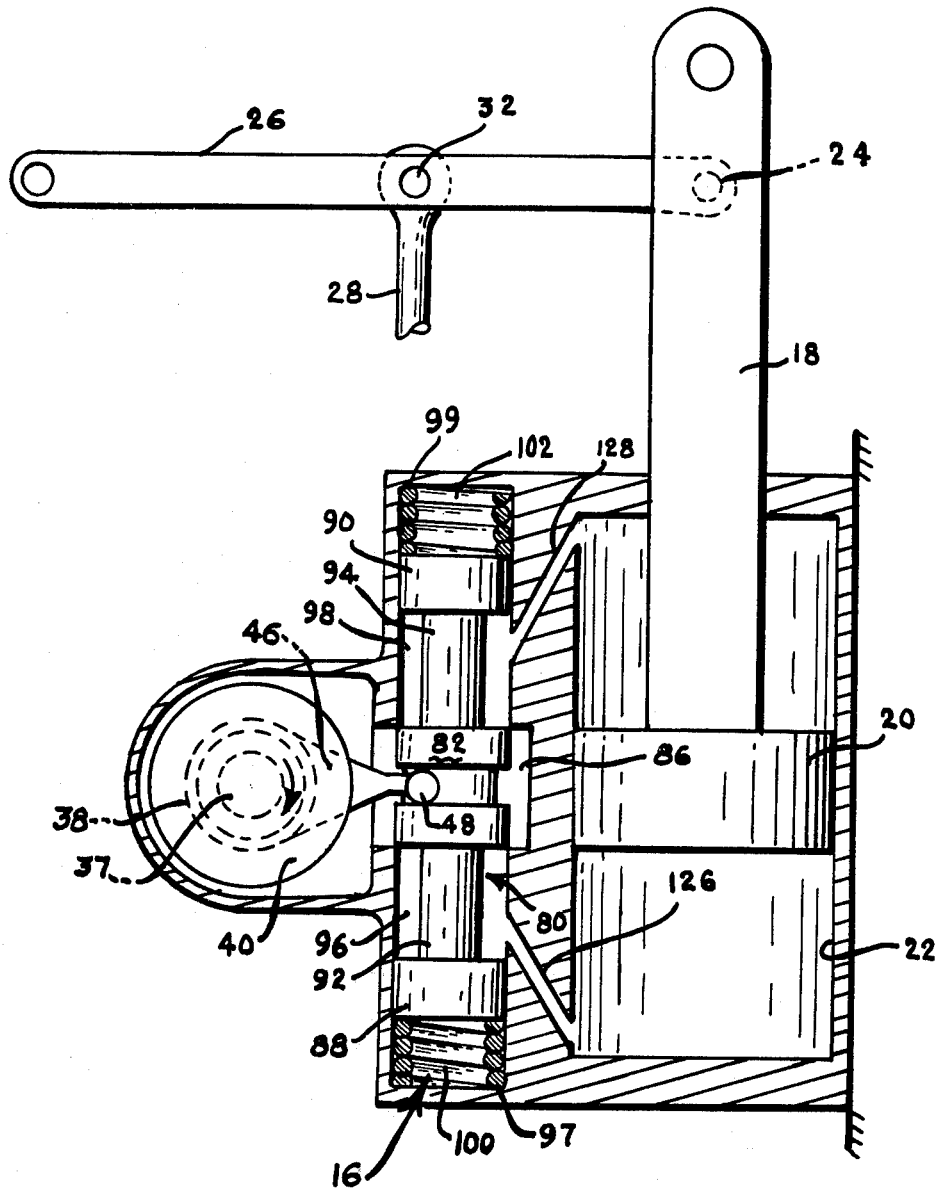
FIG. 3 is a cross sectional view of the low friction servo valve of this invention taken along line III—III of FIG. 1.

Actuator 18, as best shown in FIGS. 2 and 3 of the drawing, has pivotally attached thereto at 24 an input arm 26 which is directly connected by means of input rod 28 to an input bell crank 30. Rod 28 is pivotally connected at 32 to input arm 26 and at 34 to bell crank 30 by any conventional pivotal attachment means such as a bolt-type fastener.

Figure 1:
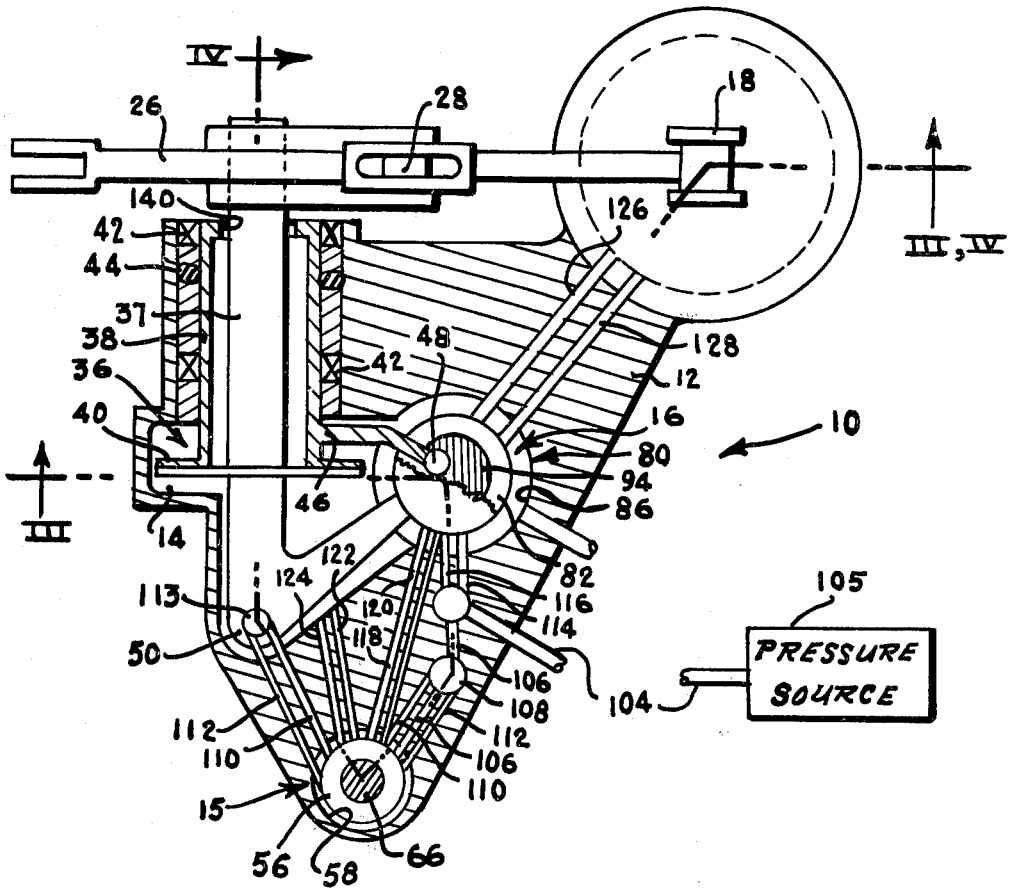
FIG. 1 is a slide elevational view of the low friction servo valve of this invention shown partly in cross section.

As clearly illustrated in FIGS. 1, 2 and 4 of the drawing bell crank 30 is fixedly secured to an input shaft 36 which is located within cavity 14. Input shaft 36 is made up of an inner shaft 37 and an outer shaft 38 secured together by any suitable conventional flex coupling 40 which is rigid in torsion and flexible laterally. Outer input shaft 38 is supported within cavity 14 of housing 12 by any suitable bearing elements 42 and seal 44. In addition, outer input shaft 38 has an arm 46, as best shown in FIGS. 1 and 3, extending therefrom and culminating in a spool knuckle joint 48 in a manner to be described in detailed hereinbelow. Inner input shaft 37 has formed as part thereof a flapper portion 50 as well as a spool feedback spring 52 formed in the direction of and terminating in boost spool cavity 16, the operation of which will also be described in detailed hereinbelow.

As clearly shown in FIG. 4 of the drawing, situated within initiator spool cavity 15 is an initator valve spool 54 made up of a central land 56 which, when valve spool 54 is its normal, centered positioned, as shown in FIG. 4 of the drawing, closes port 58 located in housing 12. In addition, a pair of outer lands 60 and 62 in axial alignment with central land 56 are connected to central land 56 by means of shafts 64 and 66 which define with the adjacent wall of housing 12 form cavity 15 fluid chambers 68 and 70. Normal centering of spool valve 54 is effected by any conventional biasing means such as springs 72 and 74 located in the end portions 76 and 78 of cavity 15 which are provided by the axial dimension of cavity 15 being greater than that of valve spool 54. Consequently, end portions 76 and 78 permit operative movement of valve spool 54 in cavity 15, provide room for springs 72 and 74, respectively, and also serve as pressure chambers at opposite ends of valve spool 54.

Located within boost spool cavity 16 in a manner similar to cavity 15 is a boost valve spool 80 made up of a central land 82 having a notched central portion 84 therein in order to accommodate feedback spring 52. An offset hole normal to the longitudinal axis of boost valve spool 80 accommodates knuckle joint 48. As with valve spool 54 in its normal, centered position, central land 82 as shown in FIG. 4 of the drawing closes port 86. Additionally, there are end lands 88 and 90 in axial alignment with central land 82. End lands 88 and 90 are connected to the central land 82 by oppositely extending axial aligned shafts 92 and 94 which define with the adjacent portions of the wall of housing 12 of cavity 15 fluid chambers 96 and 98. Normal centering of valve spool 80 is effected by springs 97 and 99 in the end portions 100 and 102, respectively, of cavity 16 in the same manner as illustrated with respect to valve spool 54. In addition, end portions 100 and 102 permit operative movement of valve spool 80 longitudinally within cavity 16 as well as serving as pressure chambers at opposite ends of valve spool 80.

The fluid pressure system for the low friction servo valve 10 of this invention includes a pressurized fluid input passage 104 which extends into housing 12 and is connected to any suitable external source of pressurized fluid 105. As clearly illustrated in FIGS. 1 and 4 of the drawing passage 104 is operably connected to (1) port 58 of cavity 15 by pressure line 106 through any suitable conventional filter 108, (2) central main cavity 14 through flow restrictors 107 and 109 by means of pressure lines 110 and 112 through a pair of jet nozzles 111 and 113, the operation of which will be described hereinbelow, and (3) boost cavity 16 by means of pressure lines 114 and 116. Chambers 68 and 70 of initiator spool cavity 15 are interconnected into boost cavity 16 by way of lines 118 and 120, respectively. Return of pressurized fluid is accomplished by lines 122 and 124, while interconnecting cylinder 22 to boost spool cavity 16 are a pair of lines 126 and 128. The relationship between these pressure lines are clearly shown in FIG. 4 of the drawing as well as in their schematic and exaggerated representation in the cross sectional view shown in FIG. 1 of the drawing.

Still referring to FIG. 4 of the drawing jet nozzles 111 and 113 are axially arranged relative to each other and have calibrated discharge orifices 130 and 132 located adjacent flapper portion 50 of inner input shaft 37. Flapper 52 is capable of movement in accordance with the movement of inner input shaft 37 as determined by the input load exerted by rod 28 on bell crank 30.

MODE OF OPERATION

For the mode of operation of this invention reference is made in particular to FIGS. 2–8 of the drawing. Initial movement of servo valve 10 of this invention takes place upon the application of an input signal in the form of, for example, a manual input load applied to input arm 26. This input signal is transmitted to the inner input shaft 37 through input bell crank 30 which is operably connected by means of rod 28 to input arm 26 as clearly illustrated in FIG. 2. Movement of input arm 26 to the position shown in FIG. 5 of the drawing causes simultaneous movement of bell crank 30 in the direction of arrow A and torque to be carried from inner input shaft 37 through flex coupling 40 to outer input shaft 38. This torque is resisted by friction in bearings 42, seal 44 the valve spool 80 at knuckle joint 48. The input load causes flex coupling 40 to flex, thereby reducing the gap 140 located between the outer input shaft 38 and the inner input shaft 37 and simultaneously causes the flexing of flapper portion 50 of inner shaft 37.

As set forth hereinabove, movement of input arm 26 to the position shown in FIG. 5 of the drawing causes bell crank 30 and therefore inner shaft 37 to rotate in the counterclockwise direction as viewed from the top in FIGS. 2 and 5 or clockwise as viewed from the bottom in FIG. 3. It should be realized that input arm 26 may, if desired, be moved in the opposite direction, thereby causing the reverse rotational movement of bell crank 30 and input shaft 36. As pointed out hereinabove, this movement of inner input shaft 37 causes a bending of flapper portion 50 to take place by causing flex coupling 40 to flex and thereby reducing the gap 144 at, for example, the right jet nozzle 132. Such a reduction in gap 144 at jet nozzle 132 increases the pressure in end portion 78 of spool cavity 15 and simultaneously increasing the gap 145 at jet nozzle 130 causing the pressure in lines 110 and 76 to drop due to less flow at restrictor 107 than jet nozzle 130 causing spool 54 to move to the left as shown in FIG. 6 of the drawing.

Motion of spool 54 to the left meters fluid under pressure through line 120 to the right end portion 102 of spool valve 80 and return pressure through lines 118 and 122. This unbalance of pressure in the ends 100 and 102 of spool 80 causes spool 80 to move to the left as shown in FIG. 7 of the drawing. Consequently, pressurized fluid flows through line 114 into chamber 96 and through pressure line 126 into hydraulic cylinder 22. Motion of spool 80 to the left causes the following to take place:

1. Spool knuckle joint 48 also moves to the left and thereby moves arm 46 and input shaft 36 in the direction of the input force acting on input shaft 36 thereby amplifying or assisting any input force thereon;

2. The hydraulic cylinder actuator rod 18 being controlled by the pressurized fluid entering cylinder 22 through line 126 moves to the right as shown in FIG. 8 of the drawing or as shown in phantom in FIG. 5 of the drawing until the pressure is equalized at jet nozzles 111 and 113 in the manner set forth hereinbelow; and 3. Spool feedback spring 52 is moved to the left in accordance with the movement of spool valve 80 as shown in FIGS. 7 and 8 of the drawing. This motion causes an unbalanced pressure at jet nozzles 111 and 113 to take place in the opposite direction as the initial movement causing initiator valve spool 54 to move back to the right which results in valve spool 80 to also move back to the right (as originally shown in FIG. 4 of the drawing) shutting off the flow of pressurized fluid through pressure lines 114 and 126 which in turn stops the motion of rod 18 in the position shown in FIG. 8.

A load on input arm 26 in an opposite direction of that described hereinabove moves spool valves 54 and 80 and therefore actuator rod 18 in the opposite direction shown in FIGS. 5–8 of the drawing. In normal operation in activating low friction servo valve 10 of this invention the input load through arm 26 will not need exceed the load required to merely deflect flex coupling 40 sufficient to bend flapper 50. Should any excess load occur it will be carried through the inner input shaft 37, flex coupling 40, outer input shaft 38 to spool 80 through joint 48. Although the nozzle flapper principle is shown here the jet pipe principle may be also utilized, with the magnitude of the input load required to move valve spool 80 being dependent on the design of flex coupling 40, primarily with regard to breakout force and rate.

In other words, the design of flex coupling 40, gaps 140 and 144, jet nozzles 111 and 113, flapper 50, feedback spring 52, the diameters of spools 54 and 80 may be easily varied to meet the desired performance of servo valve 10. For example, a very small input load through input arm 26 sufficient to reduce gap 140 only 0.001–0.003 inches is enough to move spool 80 with the result that spool 80 through knuckle joint 48 is capable of driving input shaft 36 as described hereinabove. Valve 10 is then self energizing requiring the input load to produce a load only sufficient to deflect flapper portion 50 of input shaft 36.

Although this invention has been described with reference to a particular embodiment it will be understood to those skilled in the art that this invention is also capable of a variety of alternate embodiments within the spirit and scope of the appended claims.

I claim:

1. A low friction servo valve comprising a housing, said housing having a centrally located main cavity, an initiator spool cavity and a boost spool cavity formed therein, means operably disposed within said main cavity for receiving an input signal and transferring said input signal to said initiator spool cavity, means operably disposed within said initiator spool cavity for receiving said input signal from said initiator spool cavity and providing a signal in accordance therewith to said boost spool cavity, means operably disposed within said boost spool cavity for receiving said signal from said means within said initiator spool cavity and providing three substantially simultaneous signals, the first of said three signals being directed to said input signal receiving means for supplementing said input signal, the second of said three signals being directed to an actuator causing the movement of said actuator and the third of said three signals being directed to said input signal receiving means for neutralizing said input signal receiving means from transferring said input signal whereby said actuator is capable of providing an output in direct relationship to said input signal and means operably connected between said actuator and said input receiving means for returning said input receiving means to its condition prior to receiving said input signal.

2. A low friction servo valve as defined in claim 1 wherein said input signal receiving and transferring means comprises an input shaft located within said main cavity and means for detecting the displacement of a portion of said input shaft, said displacement of said input shaft being directly related to said input signal applied to said shaft.

3. A low friction servo valve as defined in claim 2 wherein said means disposed within said initiator spool cavity and said means disposed within said boost spool cavity are valve spools.

4. A low friction servo valve as defined in claim 3 further comprising means for providing fluid under pressure and means for directing said pressurized fluid between said displacement detecting means, said initiator spool cavity and said boost spool cavity whereby the position of said initiator valve spool and said boost valve spool within their respective cavities is directly related to the pressurized fluid directed to said initiator spool cavity and boost spool cavity.

5. A low friction servo valve as defined in claim 2 wherein said input shaft comprises of an inner shaft and an outer shaft, said inner and outer shafts being secured together by a flex coupling and said displacement detecting means being in the form of a pair of jet nozzles situated adjacent a portion of said inner shaft.

6. A low friction servo valve as defined in claim 5 wherein said means disposed within said initiator spool cavity and said means disposed within said boost spool cavity are valve spools.

7. A low friction servo valve as defined in claim 6 wherein said outer shaft has an arm extending therefrom, the end of said arm being operably connected to said boost valve spool for movement therewith.

8. A low friction servo valve as defined in claim 7 wherein said inner shaft has a feedback spring formed on an end thereof, said feedback spring being operably connected to said boost valve spool for movement therewith.

9. A low friction servo valve as defined in claim 8 further comprising means for providing fluid under pressure and means for directing said pressurized fluid between said displacement detecting means, said initiator spool cavity and said boost spool cavity whereby the position of said initiator valve spool and said boost valve spool within their respective cavities is directly related to the pressurized fluid directed to said initiator spool cavity and boost spool cavity.

10. A low friction servo valve as defined in claim 9 wherein said actuator is located within a cylinder, said cylinder being operably connected to said pressurized fluid providing means and said means for returning said input receiving means to said prior input signal condition comprising an input arm and an input rod operably connected between said input receiving means and said actuator.

* * * * *